US007431520B2

(12) United States Patent
Son et al.

(10) Patent No.: US 7,431,520 B2
(45) Date of Patent: Oct. 7, 2008

(54) IMAGE FORMING APPARATUS PERFORMING DOUBLE-SIDED PRINTING

(75) Inventors: Myung-Bo Son, Anyang-si (KR); Yong-duk Lee, Gunpo-si (KR); Dong-hun Han, Suwon-si (KR)

(73) Assignee: Samsung Electronics Co., Ltd., Suwon-Si, Gyeonggi-do (KR)

( * ) Notice: Subject to any disclaimer, the term of this patent is extended or adjusted under 35 U.S.C. 154(b) by 467 days.

(21) Appl. No.: 11/174,468

(22) Filed: Jul. 6, 2005

(65) Prior Publication Data

US 2006/0024108 A1 Feb. 2, 2006

(30) Foreign Application Priority Data

Jul. 30, 2004 (KR) ..... 10-2004-0060113

(51) Int. Cl.

| | |
|---|---|
| ***B41J 2/325*** | (2006.01) |
| ***B41J 3/60*** | (2006.01) |
| ***B41J 25/304*** | (2006.01) |
| ***B41J 25/308*** | (2006.01) |

(52) U.S. Cl. ..... 400/120.16; 400/188; 400/642; 347/197

(58) Field of Classification Search ..... None
See application file for complete search history.

(56) References Cited

U.S. PATENT DOCUMENTS

| | | | | |
|---|---|---|---|---|
| 5,988,907 | A | 11/1999 | Iso | |
| 6,187,094 | B1 | 2/2001 | Mitsuhata et al. | |
| 6,296,405 | B1 | 10/2001 | Brewington et al. | |
| 6,601,952 | B2 | 8/2003 | Sugioka et al. | |
| 7,179,002 | B2 * | 2/2007 | Lee et al. | 400/120.17 |
| 2003/0146943 | A1 * | 8/2003 | Lehmkuhl et al. | 346/24 |
| 2005/0286958 | A1 * | 12/2005 | Shiratori | 400/642 |

FOREIGN PATENT DOCUMENTS

| | | | |
|---|---|---|---|
| FR | 2 769 011 | | 4/1999 |
| FR | 2 773 547 | | 7/1999 |
| JP | 03-000269 | | 1/1991 |
| JP | 05-338297 | | 12/1993 |
| JP | 10-264464 | | 10/1998 |
| JP | 2001-010743 | | 1/2001 |
| JP | 2001138472 | A * | 5/2001 |
| JP | 2006051735 | A * | 2/2006 |
| KR | 2000-0019345 | | 11/2000 |
| WO | WO 2004/058508 | | 7/2004 |

* cited by examiner

*Primary Examiner*—Daniel J Colilla
(74) *Attorney, Agent, or Firm*—Roylance, Abrams, Berdo & Goodman, L.L.P.

(57) ABSTRACT

An image forming apparatus is provided and includes a platen roller and a thermal printing head. The thermal printing head is elastically biased toward the platen roller and rotates about a pivot of the platen roller for moving between first and second positions to faces first and second surfaces of a medium. A transfer portion has driving and driven rollers which are rotatably engageable with each other to transfer the media. A guiding unit reduces a difference of media transfer force of the transfer portion when the thermal printing head is respectively located in the first and second positions.

16 Claims, 11 Drawing Sheets

IMAGE FORMING APPARATUS PERFORMING DOUBLE-SIDED PRINTING

CROSS-REFERENCE TO RELATED APPLICATIONS

This application claims the benefit of Korean Patent Application No. 10-2004-0060113, filed on Jul. 30, 2004, the entire disclosure of which is hereby incorporated by reference.

BACKGROUND OF THE INVENTION

1. Field of the Invention

The present invention relates to an image forming apparatus. More particularly, the present invention relates to an image forming apparatus in which a thermal printing head applies heat to both sides of a medium to print images.

2. Description of the Related Art

In order to print images on both sides of a medium, it is possible to equip an image forming apparatus with two thermal printing heads (TPHs). The thermal printing heads (TPH) face first and second surfaces of a medium, respectively. However, the cost of such an image forming apparatus is relatively high.

A method in which first and second surfaces of a medium sequentially faces a TPH can be considered. In this case, two methods can be considered. In one method, a TPH is fixed and a medium is reversed. In another method, a TPH is sequentially moved to locations which face the first and second surfaces of a medium. U.S. Pat. No. 6,296,405 discloses an image forming apparatus formed by combining the methods described above. A TPH is installed in a rotation bracket. The rotation bracket moves between first and second positions on a pivot shaft. When a medium passes the first position, printing to a first surface is performed. After the medium is transferred from the first position to the second position, printing to a second surface is performed. U.S. Pat. No. 6,601,952 discloses an image forming apparatus to which another method is applied. A rotation unit is formed of a TPH, a supporting element to press a medium to the TPH, and a holder supporting a medium. The rotation unit is rotated, thereby facing the TPH to first and second surfaces of the medium.

Accordingly, there is a need for an improved image forming apparatus in which a thermal printing head applies heat to both sides of a medium to print images.

SUMMARY OF THE INVENTION

An aspect of the present invention is to solve at least the above problems and/or disadvantages and to provide at least the advantages described below. Accordingly, an aspect of the present invention is to provide an image forming apparatus in which a thermal printing head is sequentially moved to first and second surfaces of a medium in order to elevate transfer accuracy of the media.

According to an aspect of the present invention, there is provided an image forming apparatus including a platen roller and a thermal printing head. The thermal printing head is elastically biased toward the platen roller and is rotatable about a pivot of the platen roller for moving between first and second positions to face first and second surfaces of a medium. A transfer portion includes driving and driven rollers which are rotatably engageable with each other to transfer the media. A guiding unit reduces a difference of a media transfer force of the transfer portion, when the thermal printing head is located in the first and second positions, respectively, by controlling an entry angle by which the media enters the transfer portion.

The guiding unit may control the entry angle by which the media enters the transfer portion so that a contact area of the media and the driving roller is the same regardless of whether the thermal printing head is located in the first position or the second position. The driving roller and the driven roller may engage with each other to form a predetermined contact nip. The guiding unit may guide the media so that the media contacts the driving roller on a width of the contact nip.

The driving roller and the driven roller may engage with each other to form a predetermined contact nip, and the driving roller may be located in a first roller position from the contact nip and the driven roller may be located in a second roller position from the contact nip. The guiding unit may include one or more first guiding elements to guide the media to reduce a winding angle by which the media winds around the driving roller when the TPH is located in the first position. The guiding unit may further include one or more second guiding elements which guide the media to reduce a winding angle by which the media winds around the driven roller when the TPH is located in the second position. The first and second guiding elements may be rollers to contact the media and rotate.

The media may be a color printing media on which ink layers representing different colors from each other are formed on both sides. When printing on the both sides is finished, images having different colors from each other are overlapped to form a color image.

According to another aspect of the present invention, there is provided an image forming apparatus including a platen roller and a thermal printing head. The thermal printing head is elastically biased toward the platen roller and is rotatable about a pivot of the platen roller for moving between first and second positions to face first and second surfaces of a medium. A driving roller and a driven roller are rotatably engageable with each other to form a contact nip having a predetermined width to transfer the media. The driving roller is located in the first position from the contact nip and the driven roller is located in the second position from the contact nip. One or more first guiding elements guide the media to reduce a winding angle by which the media winds around the driving roller when the thermal printing head is located in the first position.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
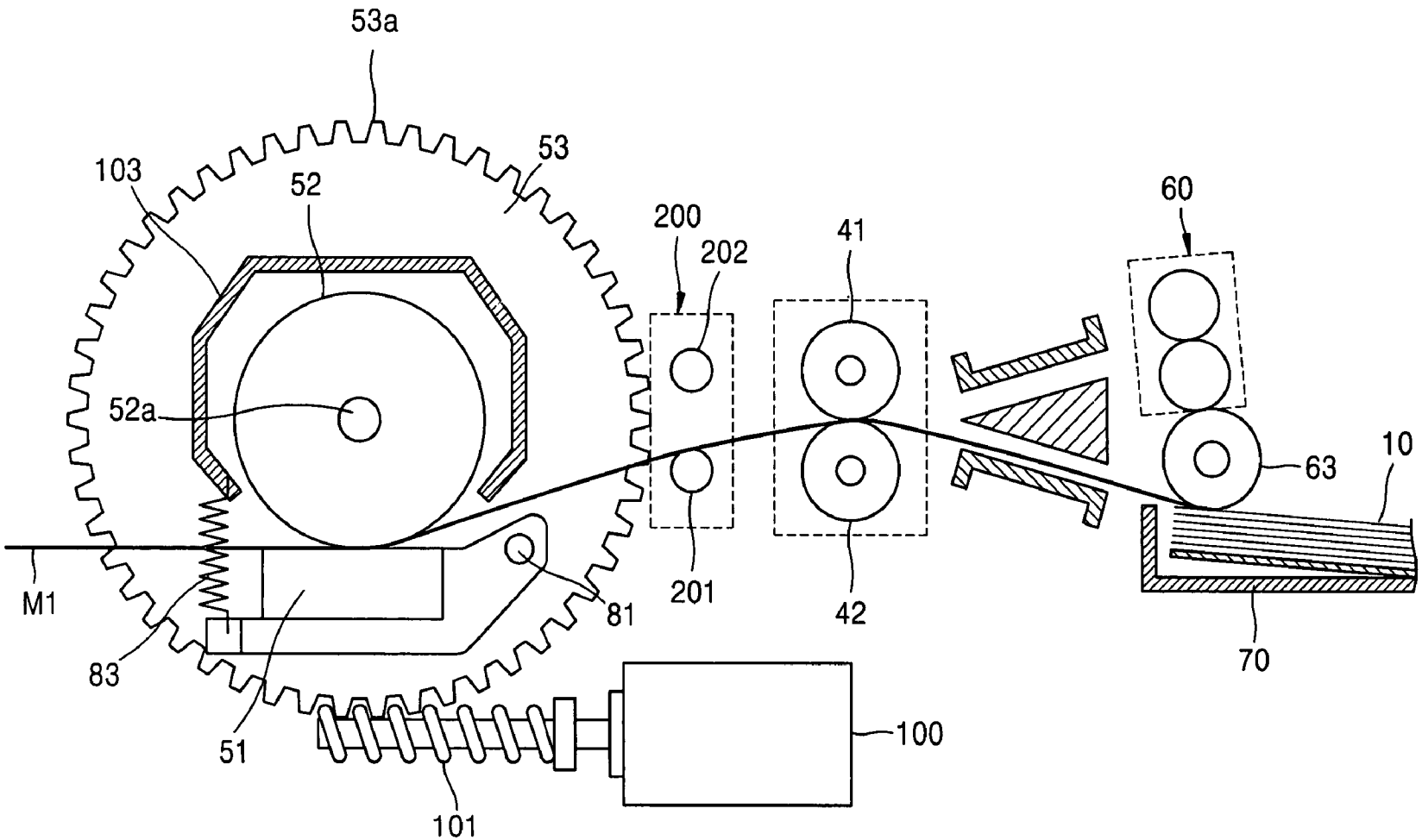
FIGS. 1 and 2 are configuration diagrams of an image forming apparatus in accordance with an embodiment of the present invention.
Figure 2:
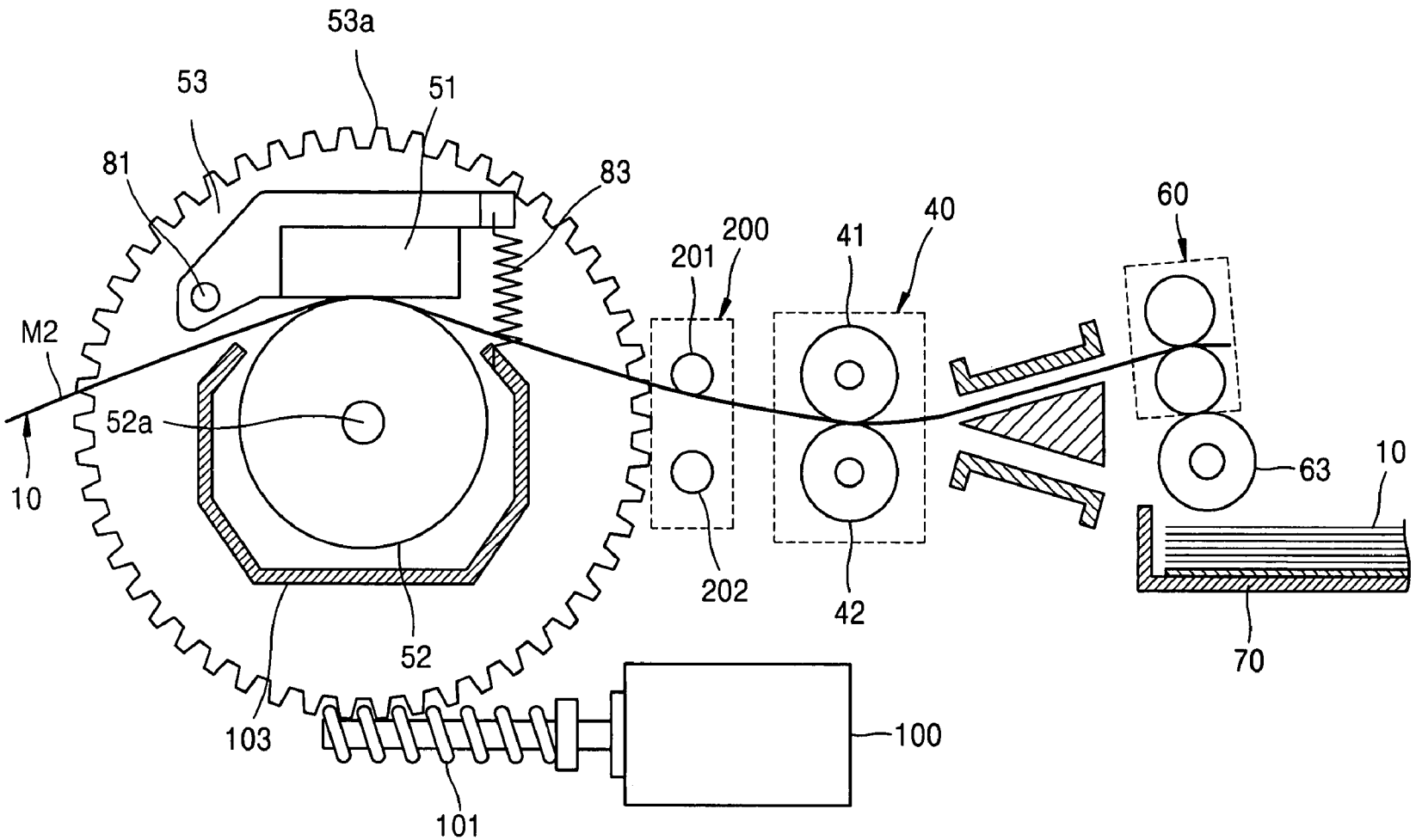

FIGS. 1 and 2 are configuration diagrams of an image forming apparatus according to an embodiment of the present invention. Referring to FIGS. 1 and 2, a thermal printing head (TPH) 51 and a platen roller 52 supporting media 10 are illustrated. The TPH 51 is elastic biased by an elastic element 83 in a direction to contact the platen roller 52. A transfer portion 40 includes a driving roller 42 and a driven roller 41 which are engaged with each other and rotate to transfer media 10. A pickup roller 63 picks up the media 10 loaded on a paper feeding cassette 70 and provides the media 10 to the driving roller 42 and the driven roller 41. A discharging portion 60 discharges the media 10 having a printed image on one surface or images on both surfaces.

In the image forming apparatus according to an embodiment of the present invention, the TPH 51 rotates about a pivot 52*a* of the platen roller 52 to move between a first position of FIG. 1 and a second position of FIG. 2. Also, in the image forming apparatus, the TPH 51 is installed to contact or to depart from the platen roller 52 elastically. For this, a supporting bracket 53 is pivotally installed on the pivot 52*a*. A cover 103 surrounding the platen roller 52 is combined with the supporting bracket 53. The TPH 51 is combined with the supporting bracket 53 for pivoting on a hinge shaft 81. The elastic element 83 is preferably a tensile spring of which one end is combined with the TPH 51 and the other end is combined with the cover 103.

For example, to move the TPH 51 to a first position or a second position, a gear portion 53*a* provided on the outer surface of the supporting bracket 53 and a motor 100 driving a worm gear 101 are engaged with the gear portion 53*a*. According to the structure as described above, the supporting bracket 53 is rotated by the motor 100, thereby moving the TPH 51 to the first or second position. An exemplary structure in which the TPH 51 rotates about the pivot 52*a* of the platen roller 52 for moving between the first and second positions is cited in Korean application No. 2003-101583 filed on Dec. 31, 2003, and Korean application No. 2004-42504 filed on Jun. 10, 2004, by the present assignee; but, the technical scope of the image forming apparatus in accordance with an embodiment of the present invention is not defined by the structure disclosed in the application documents filed.

An image forming process performed by the image forming apparatus of FIG. 1 in accordance with an embodiment of the present invention will now be described.

Figure 3A:
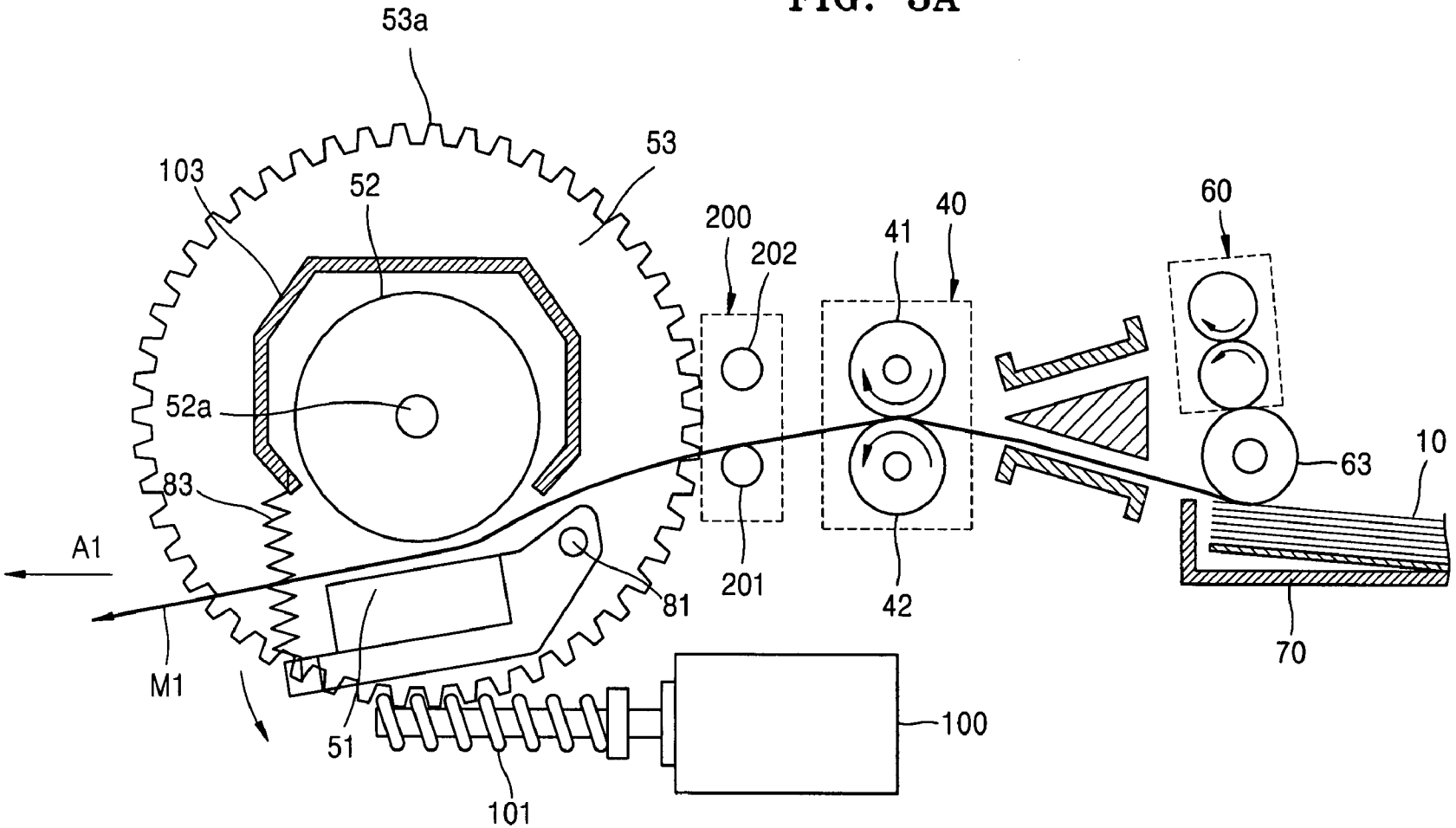
FIGS. 3A through 3F are diagrams illustrating an image forming process performed by the image forming apparatus of FIG. 1.

Referring to FIG. 3A, the TPH 51 is located in the first position. The TPH 51 departs from the platen roller 52. The medium 10 is picked up by the pickup roller 63 from the paper feeding cassette 70 and is transferred by the transfer portion 40 in a first direction A1. The medium 10 is transferred between the TPH 51 and the platen roller 52.

Figure 3B:
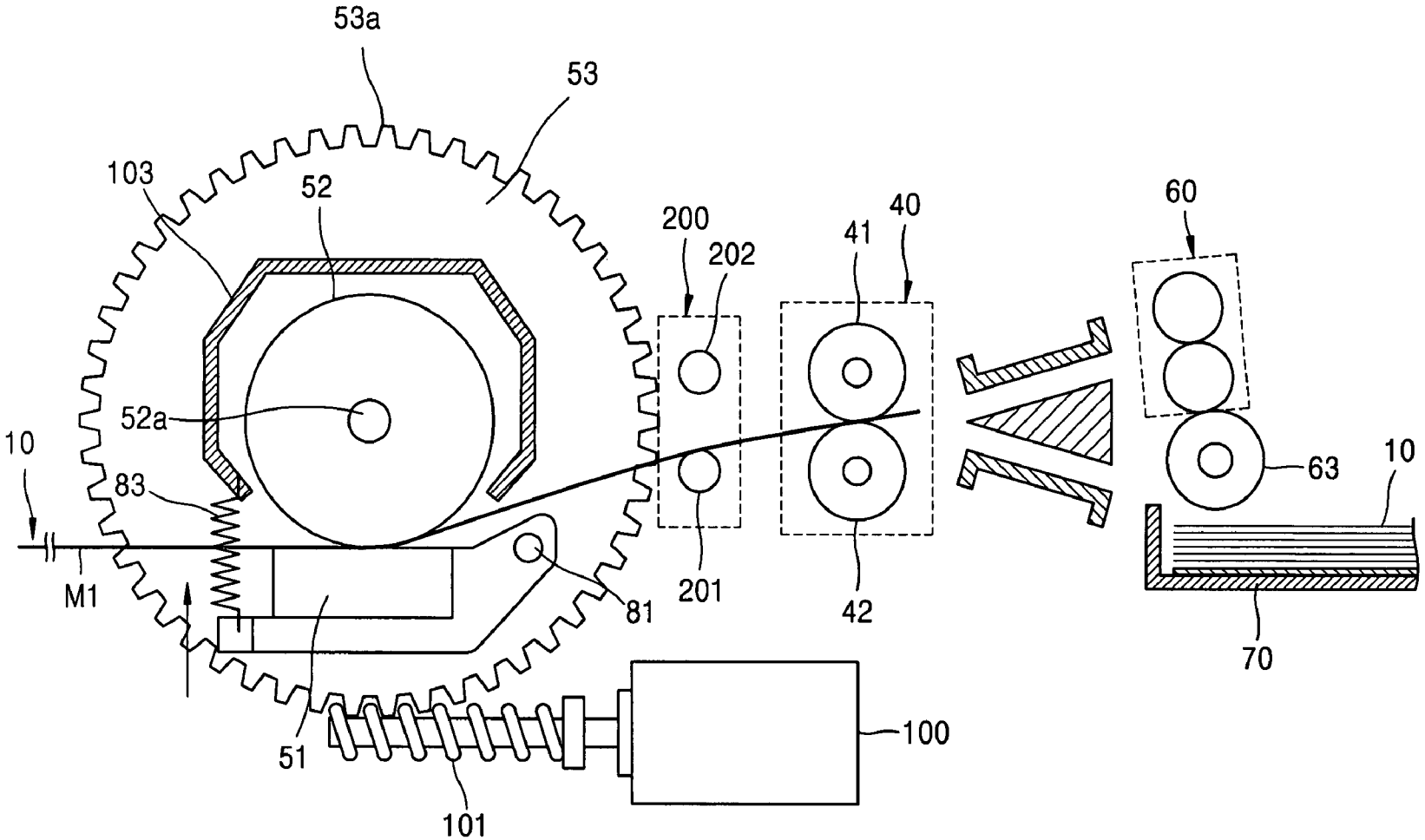

Referring to FIG. 3B, when the medium 10 arrives at a print starting position, the transfer portion 40 stops transferring the medium 10 and the TPH 5 1 approaches the platen roller 52. The TPH 51 contacts a first surface M1 of the medium 10 via elasticity of the elastic element 83.

Figure 3C:
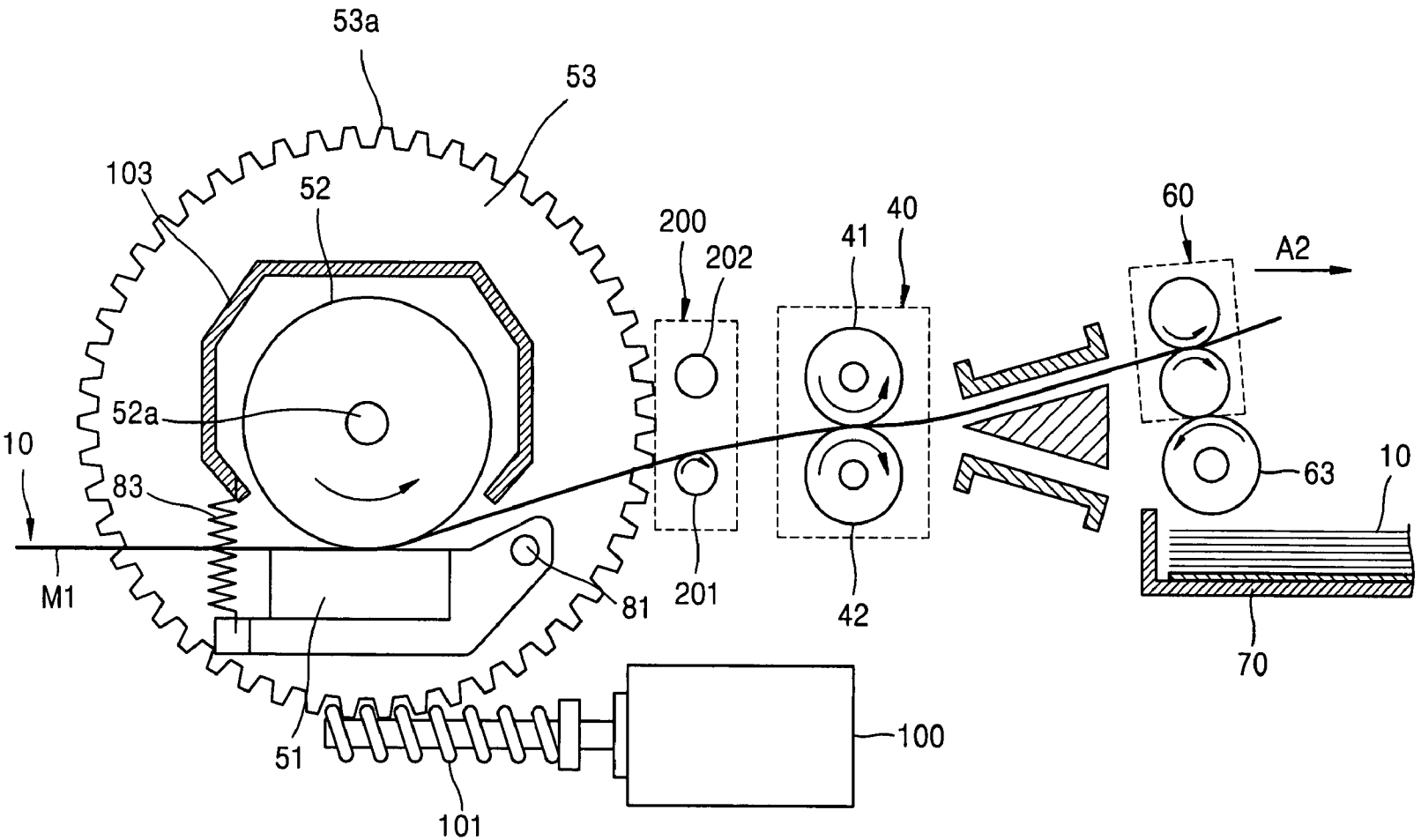
Figure 3D:
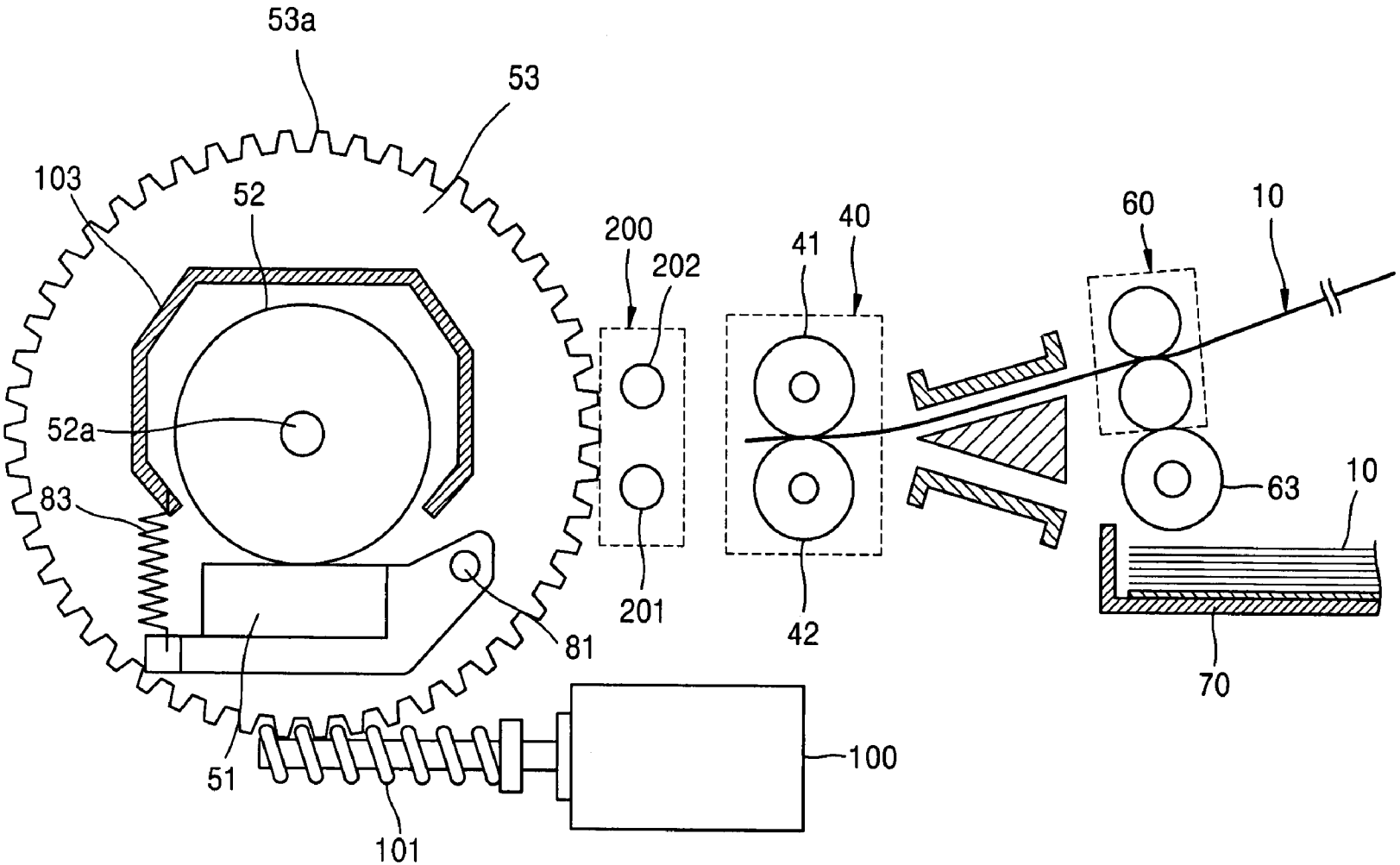

Referring to FIG. 3C, the transfer portion 40 transfers the medium 10 in a second direction A2 at a predetermined printing speed. The TPH 51 applies heat to the first surface M1 of the medium 10 to print an image. The medium 10 is temporarily discharged by the discharging portion 60. Referring to FIG. 3D, when printing to the first surface M1 of the medium 10 is finished, the transfer portion 40 stops transferring the medium 10.

Figure 3E:
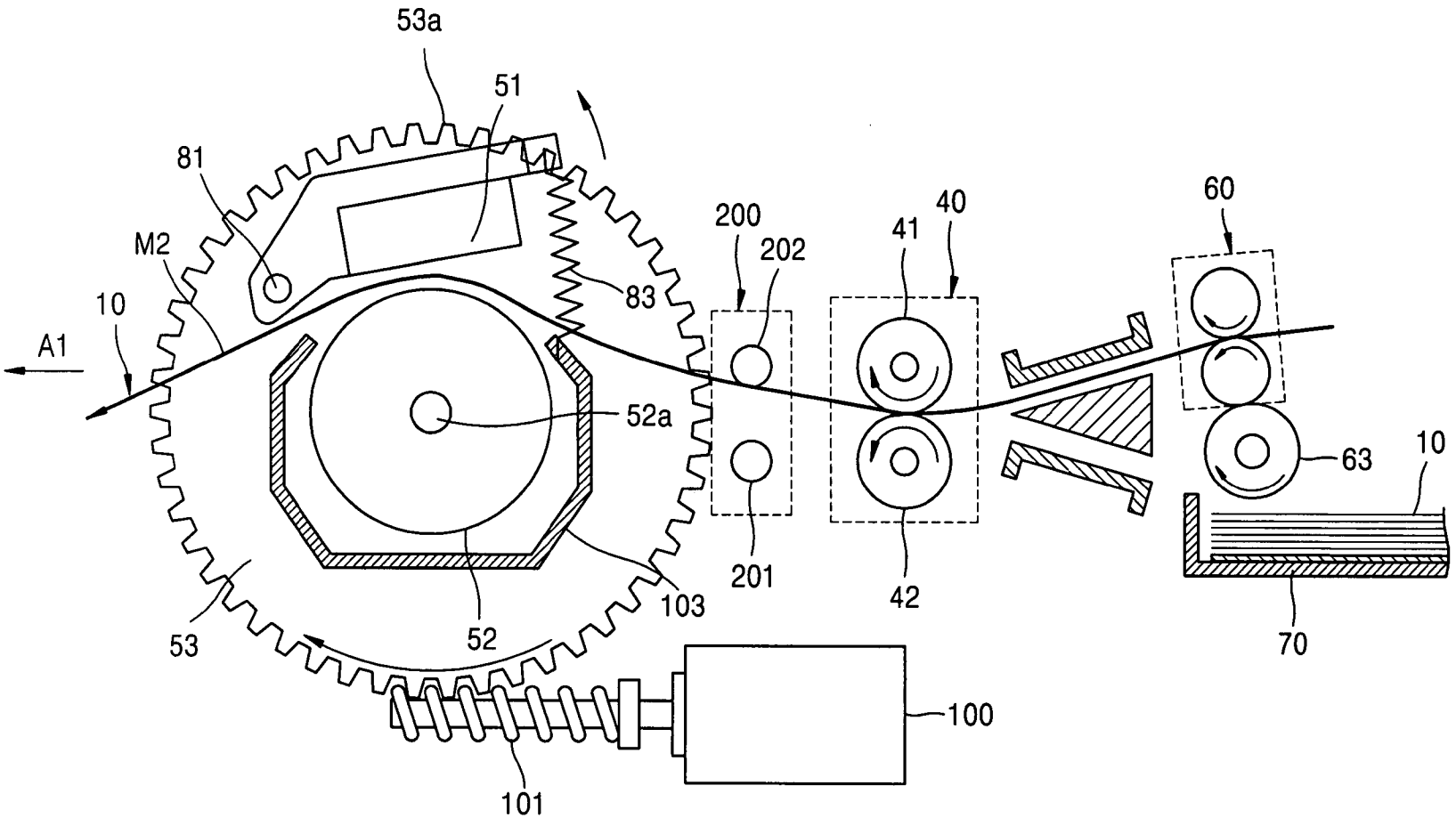

Now, the TPH 51 is faced with a second surface M2 of the medium 10. Referring to FIG. 3E, the TPH 51 rotates about the pivot 52*a* of the platen roller 52 for positioning in the second position. In this case, the cover 103 is rotated together with the TPH 51. Then, the TPH 51 departs from the platen roller 52 and the transfer portion 40 transfers the medium 10 in the first direction A1 to the print starting position.

Figure 3F:
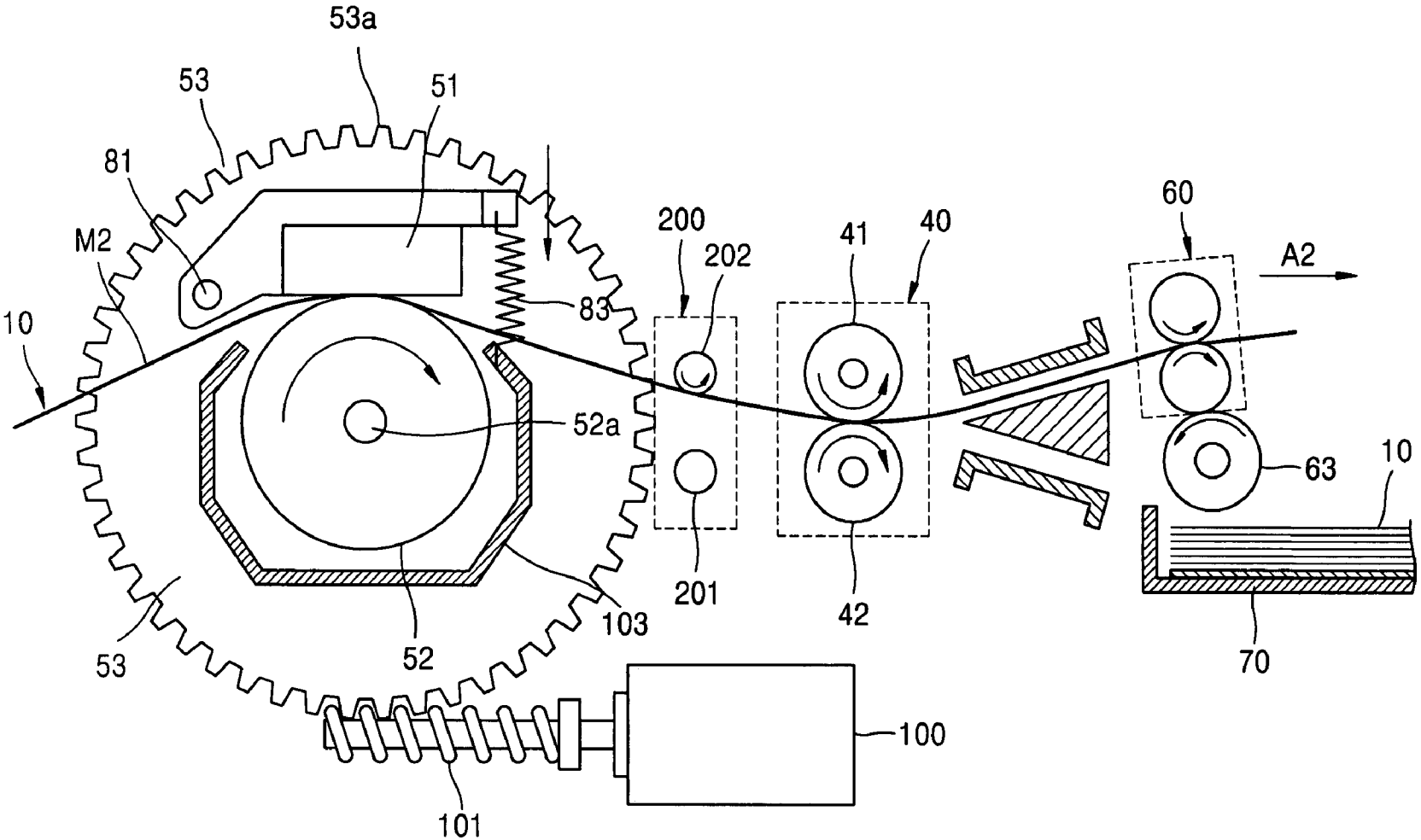

Next, referring to FIG. 3F, the TPH 51 approaches the platen roller 52. The TPH 51 contacts the second surface M2 of the medium 10 via elasticity of the elastic element 83. The transfer portion 40 transfers the medium 10 in the second direction A2 at a predetermined printing speed. The TPH 51 applies heat to the second surface M2 of the medium 10 to print an image. When the printing is finished, the medium 10 is discharged by the discharging portion 60.

Figure 4:
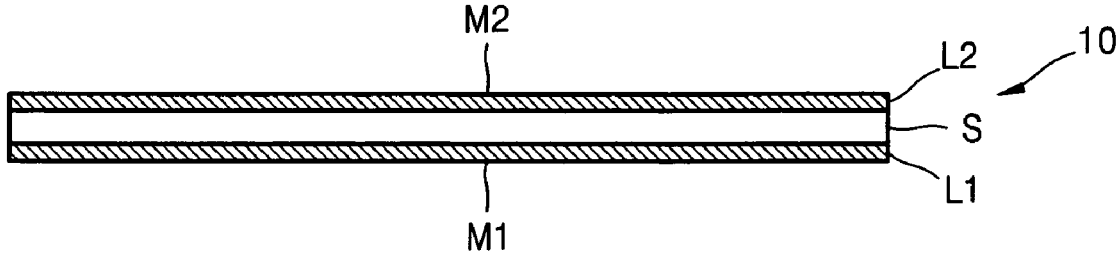
FIG. 4 is a cross-sectional view of an exemplary media.

The media 10 has a configuration as shown in FIG. 4. The configuration includes ink layers L1 and L2, which react to heat to represent predetermined colors, and are respectively formed on the first surface and second surfaces M1 and M2. The respective ink layers L1 and L2 may include a single-layer for representing a single color or a multi-layer for representing two colors or more. As a first example, the ink layer L1 may have two layers for representing yellow and magenta. The ink layer L2 also may have a layer for representing cyan. The yellow and magenta may be selectively revealed according to a temperature and heating time of the TPH 51. For example, the yellow may be revealed by heating at a high temperature for a short time, and the magenta may be revealed by heating at a low temperature for a long time. Of course, an alternative case or conditions may be entirely possible. When a substrate S is a transparent material, the yellow, magenta, cyan of the ink layers L1 and L2 are respectively revealed. Thus, the three colors overlap, thereby representing a color image. The medium 10 as described above is disclosed in U.S. Patent Laid-Open No. US2003/0125206.

As a second example, when the substrate S is an opaque material, different images are respectively printed on the first and second surfaces M1 and M2. Thus, rendering performance of double-sided printing possible. The scope of the image forming method is not defined by the configuration of the ink layers L1 and L2 of the first and second surfaces M1 and M2 of the medium 10, and other suitable arrangements and constructions may be used.

Generally, the transfer portion 40 is formed as the driving roller 42 and driven roller 41 are engaged with each other as shown in FIGS. 1 and 2. A predetermined force is applied to the driven roller 41 in a direction for contacting the driving roller 42. Rotary power of a motor (not shown) is delivered to the driving roller 42, and the driven roller 41 is subordinately rotated. Generally, the driving roller 42 is a rigid roller such as metal, and the driven roller 41 is a rubber roller; however, other suitable arrangements and constructions may be used.

When the driving roller 42 is a rubber roller, solidity of the driving roller 42 is generally greater than the solidity of the driven roller 41.

Figure 5:
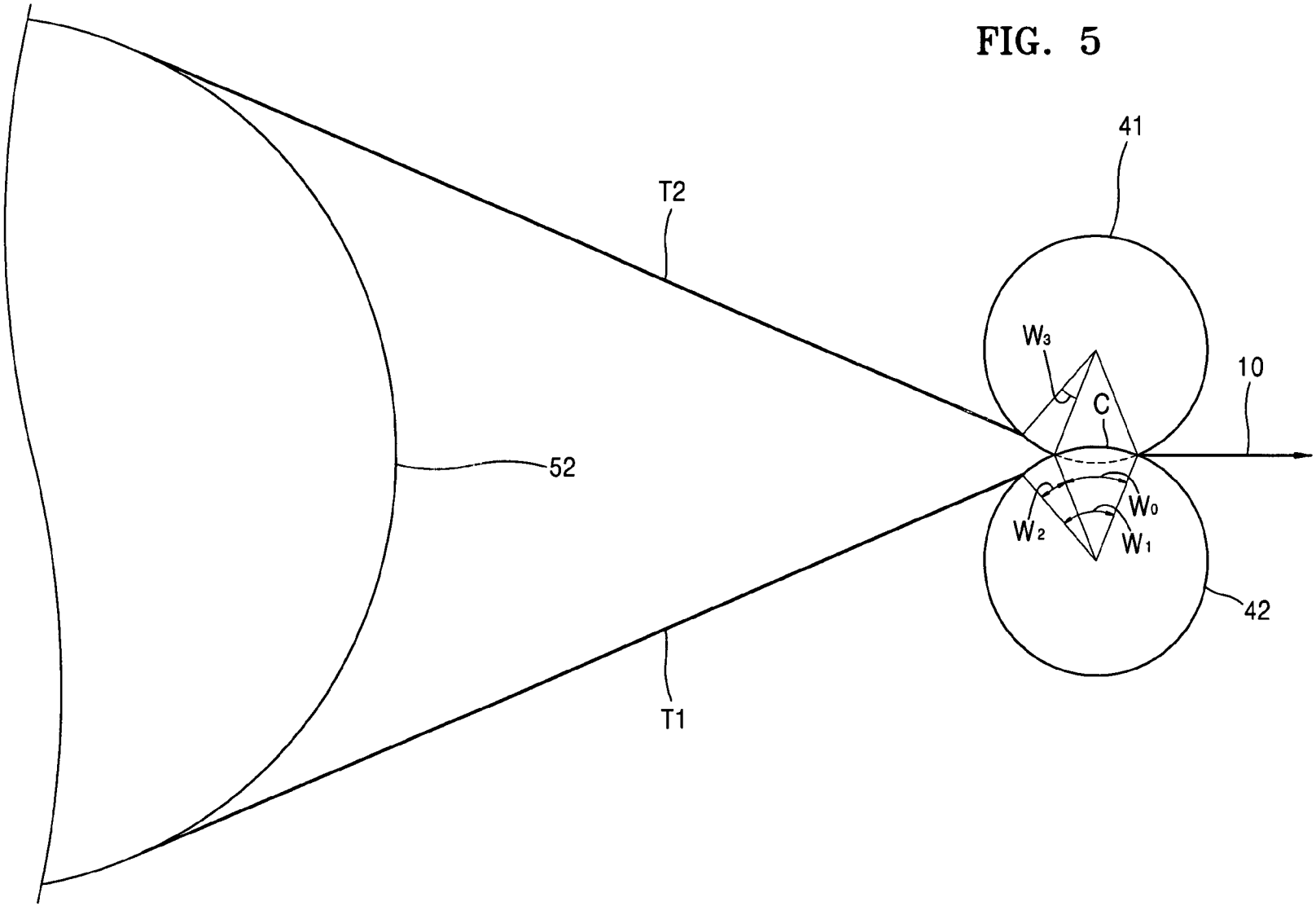
FIG. 5 is a diagram showing a medium transfer path according to a position of a thermal printing head.

Referring to FIG. 5, when the driving roller 42 and the driven roller 41 contact with each other, the driven roller 41 deforms slightly and a contact nip C occurs. A width of the contact nip C depends on solidity of the driven roller 41 and a magnitude of the force applied to the driven roller 41. In an embodiment of the present invention, the driving roller 42 is located in a first roller position from the contact nip C, and the driven roller 41 is located in a second roller position from the contact nip C. Accordingly, when the TPH 51 is located in the first position, the medium 10 is transferred along a tangent line T1 of the platen roller 52 and the driving roller 42. When the TPH 51 is located in the second position, the medium 10 is transferred along a tangent line T2 of the platen roller 52 and the driven roller 41. A media transfer force of the transfer portion 40 depends on a winding angle of the medium with respect to the driving roller 42. The greater the winding angle, the greater the media transfer force. When the medium 10 is transferred along the tangent line T1, a winding angle $W_1$ by which the medium 10 winds around the driving roller 42 is equal to a winding angle $W_0$ plus a winding angle $W_2$. Here, the winding angle $W_0$ corresponds to the contact nip C. When the medium 10 is transferred along the tangent line T2, the medium 10 winds around the driving roller 42 by the winding angle $W_0$. Accordingly, when the TPH 51 is located in the first position, the media transfer force of the transfer portion 40 is greater than when the TPH 51 is located in the second position. Additionally, when the TPH 51 is located in the second position, since the driven roller 41 is subordinately driven to the driving roller 42, the greater winding angle $W_3$, by which the medium 10 winds around the driven roller 41, is greater as the media transfer force of the transfer portion 40 decreases. Then, when the TPH 51 is located in the second position, a slip occurs in the transfer portion 40.

When images are printed on both sides to form a color image or double-sided printing is performed using the image forming apparatus of FIGS. 1 and 2, preferably, the media transfer force of the transfer portion 40, when the TPH 51 is located in the first position, may be almost identical with the media transfer force when the TPH 51 is located in the second position. Only in this case, the medium 10 can be transferred at a fixed speed, thereby obtaining printing images of relatively good quality. When a color image is printed, in order to obtain good quality color images, yellow and magenta images printed on the first surface M1 must be accurately overlapped with a cyan image. If the media transfer force of the transfer portion 40 becomes different, according to whether the TPH 51 is located in the first position or second position, the yellow and magenta images printed on the first surface M1 and the cyan image printed on the second surface M2 are out of line. Consequently, printing quality degrades.

Figure 6:
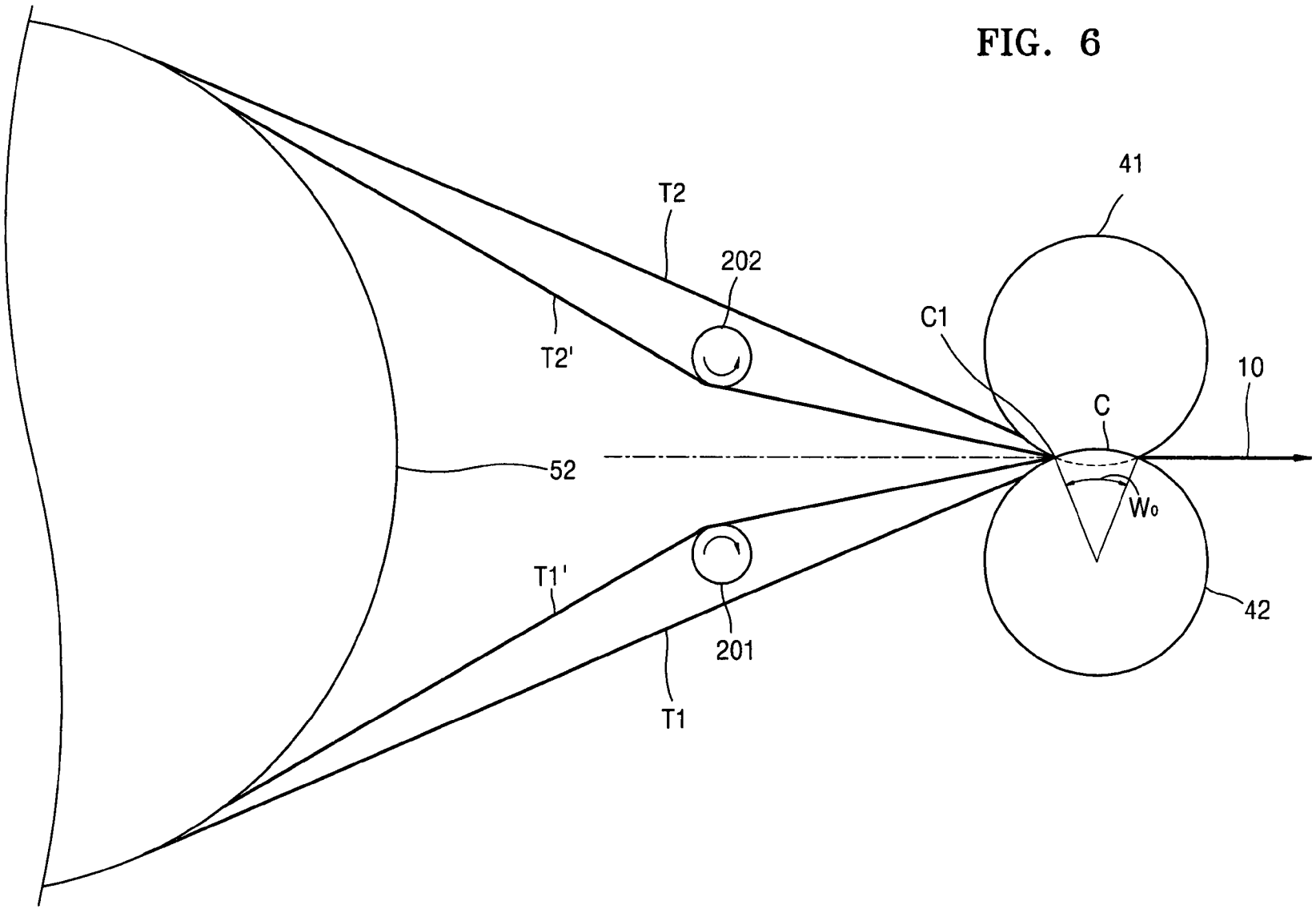
FIG. 6 is a diagram showing an operation of a guiding element.

In order to reduce a difference of the media transfer force of the transfer portion 40 between a case in which the TPH 51 is located in the first position and another case in which the TPH 51 is located in the second position, an entry angle by which the medium 10 enters the transfer portion 40 may be controlled. Controlling the entry angle reduces the winding angle $W_2$ and/or the winding angle $W_3$. For this, referring to FIGS. 1 and 2, the image forming apparatus is equipped with a guiding unit 200. Referring to FIG. 6, the guiding unit 200 includes a first guiding element 201 for reducing the media transfer force of the transfer portion 40 when the TPH 51 is located in the first position. The first guiding element 201 may be a roller which contacts the medium 10 and rotates in order to reduce a contact resistance between the medium 10 and the first guiding element 201. The first guiding element 201 is preferably installed above the tangent line T1. The medium 10 enters the transfer portion 40 along a tangent line T1', which connects the platen roller 52, the first guiding element 201, and the driving roller 42. Then, the entry angle by which the medium 10 enters the transfer portion 40 becomes more obtuse than when the first guiding element 201 is not installed. The winding angle $W_2$, by which the medium 10 winds around the driving roller 42, is reduced. If the winding angle $W_2$ is reduced, the media transfer force of the transfer portion 40 is reduced when the TPH 51 is located in the first position. The difference between when the TPH 51 is located in the first position and when the TPH 51 is located in the second position can be reduced.

The guiding unit 200 may include a second guiding element 202 for increasing the media transfer force of the transfer portion 40 when the TPH 51 is located in the second position. The second guiding element 202 may be a roller which contacts the media 10. The second guiding element rotates in order to reduce a contact resistance with the media 10. The second guiding element 202 is installed below the tangent line T2. The media 10 enters the transfer portion 40 along a tangent line T2', which connects the platen roller 52, the second guiding element 202, and the driven roller 41. Then, the entry angle of the media 10, which enters the transfer portion 40, becomes more obtuse than when the second guiding element 202 is not installed. Therefore, the winding angle $W_3$, by which the media winds around the driven roller 41, is reduced. When the winding angle $W_3$ is reduced, the transfer force of the transfer portion 40, when the TPH 51 is located in the second position, increases. That is, transfer resistance caused by the winding angle $W_3$ is reduced. Accordingly, the difference between when the TPH 51 is located in the first position and when the TPH 51 is located in the second position can be reduced.

If the locations of the first and second guiding elements 201 and 202 are controlled, the winding angles $W_2$ and $W_3$ can be approximately 0. The media 10 contacts the driving roller 42 on a width of the contact nip C. Then, the transfer force of the transfer portion 40, when the TPH 51 is located in the first position, is approximately identical with the transfer force of the transfer portion 40 when the TPH 51 is located in the second position. The image forming apparatus is equipped with one first guiding element 201 and one second guiding element 202. However, the image forming apparatus may include a plurality of the first and second guiding elements 201 and 202.

As described above, in the image forming apparatus in accordance with the present invention, a difference of transfer forces of a transfer portion according to positions of the TPH is reduced or removed. Thus, transfer accuracy of the transfer portion and printing quality are improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus comprising:

a platen roller;

a thermal printing head being elastically biased toward the platen roller and moving between first and second positions to face first and second surfaces of a medium;

a transfer portion to transfer the media; and a guiding unit being located between the printing head/platen roller and the transfer portion to control the angle of entry of the medium into the transfer portion.

2. The apparatus of claim 1, wherein the printing head moves between the first and second positions relative to the platen roller by pivoting about an axis of the platen roller.

3. The apparatus of claim 2, wherein the guiding unit reduces a difference of a media transfer force of the transfer portion, when the thermal printing head is respectively located in the first and second positions, by controlling an entry angle by which the media enters the transfer portion.

4. The apparatus of claim 3, wherein the transfer portion includes driving and driven rollers being rotatably engageable with each other to transfer the media.

5. The apparatus of claim 3, wherein the guiding unit controls the entry angle by which the media enters the transfer portion so that a contact area of the media and the driving roller is the same regardless of whether the thermal printing head is located in the first position or the second position.

6. The apparatus of claim 5, wherein the driving roller and the driven roller engage with each other to form a predetermined contact nip, and the guiding unit guides the media so that the media contacts the driving roller on a width of the contact nip.

7. The apparatus of claim 3, wherein:

the driving roller and the driven roller engage with each other to form a predetermined contact nip, and the driving roller is located in a first roller position from the contact nip and the driven roller is located in a second roller position from the contact nip, and the guiding unit includes one or more first guiding elements which guide the media to reduce a winding angle by which the media winds around the driving roller when the TPH is located in the first position.

8. The apparatus of claim 7, wherein the first guiding element is a roller which contacts the media and rotates.

9. The apparatus of claim 7, wherein the guiding unit further includes one or more second guiding elements which guide the media to reduce a winding angle by which the media winds around the driven roller when the TPH is located in the second position.

10. The apparatus of claim 9, wherein the second guiding element comprises a roller, which rotates and contacts the media.

11. The apparatus of claim 3, wherein the media is a color printing media on which ink layers representing different colors from each other are formed on both sides, and when printing on the both sides is finished, images having different colors from each other are overlapped to form a color image.

12. An image forming apparatus comprising:

a platen roller;

a thermal printing head being elastically biased toward the platen roller and being rotatable about a pivot of the platen roller for moving between first and second positions to face first and second surfaces of a medium;

a driving roller and a driven roller being rotatably engageable with each other to form a contact nip having a predetermined width to transfer the media, and the driving roller is located in a first roller position from the contact nip and the driven roller is located in a second roller position from the contact nip; and one or more first guiding elements to guide the media to reduce a winding angle by which the media winds around the driving roller when the thermal printing head is located in the first position.

13. The apparatus of claim 12, wherein the first guiding element comprises a roller, which rotates and contacts the media.

14. The apparatus of claim 12, further comprising one or more second guiding elements to guide the media to reduce a winding angle by which the media winds around the driven roller when the TPH is located in the second position.

15. The apparatus of claim 14, wherein the second guiding element comprises a roller, which rotates and contacts the media.

16. The apparatus of claim 12, wherein the media is a color printing media on which ink layers representing colors different from each other are formed on both sides of a substrate, and when printing on both sides is finished, images having different colors are overlapped to form a color image.

* * * * *